US010883743B2

(12) United States Patent
Boros

(10) Patent No.: US 10,883,743 B2
(45) Date of Patent: Jan. 5, 2021

(54) WATER HEATER WITH FLOW BYPASS

(71) Applicant: Rheem Manufacturing Company, Atlanta, GA (US)

(72) Inventor: Jozef Boros, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 49 days.

(21) Appl. No.: 16/054,431

(22) Filed: Aug. 3, 2018

(65) Prior Publication Data

US 2019/0041095 A1 Feb. 7, 2019

Related U.S. Application Data

(60) Provisional application No. 62/541,037, filed on Aug. 3, 2017.

(51) Int. Cl.

| | |
|---|---|
| ***F24H 1/18*** | (2006.01) |
| ***F24H 9/12*** | (2006.01) |
| ***F24H 9/20*** | (2006.01) |
| ***F24H 1/10*** | (2006.01) |
| ***F24H 9/18*** | (2006.01) |
| ***F24H 9/14*** | (2006.01) |
| ***F24H 9/00*** | (2006.01) |
| ***F24D 19/10*** | (2006.01) |

(52) U.S. Cl.

CPC ..... *F24H 9/2035* (2013.01); *F24D 19/1051* (2013.01); *F24H 1/107* (2013.01); *F24H 9/0005* (2013.01); *F24H 9/128* (2013.01); *F24H 9/142* (2013.01); *F24H 9/1836* (2013.01); *F24D 2220/044* (2013.01); *F24H 2210/00* (2013.01)

(58) Field of Classification Search

CPC . F24H 1/18; F24H 1/0018; F24H 1/00; F24H 9/124; F24H 9/126; F24H 9/20; F24H 9/2035; F24D 19/088

See application file for complete search history.

(56) References Cited

U.S. PATENT DOCUMENTS

| | | | | |
|---|---|---|---|---|
| 3,190,284 A * | 6/1965 | Koepf | F24H 9/124 | 126/362.1 |
| 4,305,547 A * | 12/1981 | Cohen | F24H 1/208 | 122/15.1 |
| 5,347,956 A * | 9/1994 | Hughes | F24H 9/124 | 122/14.3 |
| 6,370,328 B1 * | 4/2002 | Mottershead | F24H 1/202 | 126/639 |
| 7,971,603 B2 * | 7/2011 | Willis | F28F 9/02 | 137/454.6 |

(Continued)

*Primary Examiner* — Gregory A Wilson

(74) *Attorney, Agent, or Firm* — Troutman Pepper Hamilton Sanders LLP

(57) ABSTRACT

A water heater has a water supply line, a heat exchanger in fluid communication with the water supply line, a heating element positioned proximate to the heat exchanger, such that when activated, the heating element conveys heat to the heat exchanger and thereby heating water supplied by the water supply line, an output line in fluid communication with the heat exchanger and configured to receive heated water therefrom, a flow sensor configured to cause the heating element to activate in response to sensing a predetermined water flow rate through the water heater, and a bypass flow line operably connected between the water supply line and the output line.

17 Claims, 7 Drawing Sheets

(56) References Cited

U.S. PATENT DOCUMENTS

| | | | | |
|---|---|---|---|---|
| 8,437,626 | B2 * | 5/2013 | Ding | F24D 3/08 392/307 |
| 8,695,539 | B2 * | 4/2014 | Iwama | F24H 1/145 122/18.1 |
| 9,268,342 | B2 * | 2/2016 | Beyerle | G05D 23/1346 |
| 10,215,445 | B1 * | 2/2019 | Mottershead | F24H 9/2007 |
| 2019/0360225 | A1 * | 11/2019 | Dzindo | F24H 9/2028 |

* cited by examiner

WATER HEATER WITH FLOW BYPASS

CROSS REFERENCE TO RELATED APPLICATIONS

The present application claims priority to U.S. Provisional Patent Application No. 62/541,037 filed Aug. 3, 2017 and titled "Water Heater With Flow Bypass," the entire contents of which are incorporated herein by reference.

FIELD OF THE INVENTION

The present invention generally relates to a water heater and more particularly relates to a water heater with a flow bypass.

BACKGROUND OF THE INVENTION

Hot water heaters are used to heat and store a quantity of water in a storage tank for subsequent on-demand delivery to plumbing fixtures such as sinks, bathtubs, showers, and appliances in residential and commercial buildings. A typical demand based water heater uses a combustible fuel gas, such as methane (i.e. natural gas), wherein a gas burner disposed in a combustion chamber below a heat exchanger burns the gas with ambient air, thereby heating the water with a combination of heat radiated from the burner and heat conducted from hot gaseous products of combustion (hereinafter, "combustion gasses") traveling through the walls of the combustion chamber and through the heat exchanger. The combustion gasses travel from the combustion chamber, through the heat exchanger and, ultimately, vent outside of the building or other enclosure in which the tank is disposed.

Tankless water heaters eliminate the need for storing volumes of hot water by heating water on demand. Other demand based water heaters may include high recovery water heaters. High recovery water heaters may be similar to tankless water heaters, but include a relatively small storage vessel that receives a volume, such as 5 liters to 9 liters, of heated water from the heat exchanger. The storage vessel may reduce variation in the outlet temperature of the heat exchanger by allowing for mixing of the water exiting the heat exchanger with the water in the storage vessel. Additionally, the heated water in the storage vessel may provide heated water to supply the demand while the heat exchanger of the water heater is warmed to operating temperature.

On-demand water heaters typically include one or more flow switches, which may sense flow through the water heater indicating a demand for heated water. The flow switch may be configured to indicate a demand in response to sensing a flow rate greater than a predetermined flow rate threshold. In response to a signal from the flow switch, the water heater actuates a gas burner to heat the water that is now flowing through the water heater. However, the flow rate through the water heater may vary in response to variation in supply pressure of the local water supply. In some instances, a low pressure condition may cause the flow rate through the water heater to remain below the predetermined flow rate value at which the flow switch is configured to indicate a demand, thereby precluding the flow switch from sending a signal to the water heater controller to activate the burner. Thus, it is possible in such circumstances that a user may actuate an appliance, so that heated water is needed, but the water heater fails to actuate the burner because the low input water pressure prevents flow from reaching the switch's trigger level.

SUMMARY OF THE INVENTION

The present invention recognizes and addresses considerations of prior art constructions and methods.

In an example embodiment, a water heater has a water supply line, a heat exchanger in fluid communication with the water supply line, and a heating element positioned proximate to the heat exchanger so that, when activated, the heating element conveys heat to the heat exchanger, thereby heating water supplied to the heat exchanger by the water supply line. An output line is in fluid communication with the heat exchanger and configured to receive heated water therefrom. A water flow sensor is in operative communication with water flow to or in the water heater to detect water flow from the water supply line to the water heater and in operative communication with the heating element to cause the heating element to activate in response to detection of a predetermined water flow rate by the water flow sensor. A bypass water flow line is operably connected between the water supply line and the output line.

In another example embodiment, a water heater has a water supply line, a heat exchanger in fluid communication with the water supply line, and a heating element positioned proximate to the heat exchanger so that, when activated, the heating element conveys heat to the heat exchanger, thereby heating water supplied to the heat exchanger by the water supply line. An output line is in fluid communication with the heat exchanger and configured to receive heated water therefrom. The outlet line comprises a storage vessel configured to store a volume of the heated water. A water flow sensor is in operative communication with water flow to or in the water heater to detect water flow from the water supply line to the water heater and in operative communication with the heating element to cause the heating element to activate in response to sensing a predetermined water flow rate by the water flow sensor. A bypass water flow line is operably connected between the water supply line and the output line.

The bypass flow line may be a low resistance flow path around the heat exchanger. The low resistance flow path may enable the flow rate sensed by the flow sensor to be greater than it otherwise would be, in absence of the bypass flow path, to thereby increase the likelihood that water flow under low pressure conditions will reach or exceed the predetermined flow rate threshold indicative of a demand for heated water. In some example embodiments, a bypass valve may be disposed in the bypass flow line that is configured to open in response to a low pressure condition, e.g. a pressure less than a predetermined pressure threshold, sensed at a water supply line, e.g. a cold water inlet, and to close in response to the pressure of the water supply line above the low pressure threshold. The bypass valve may limit flow in the bypass flow line to low pressure conditions, thereby maximizing flow through the heat exchanger in the absence of a low pressure condition.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 3:
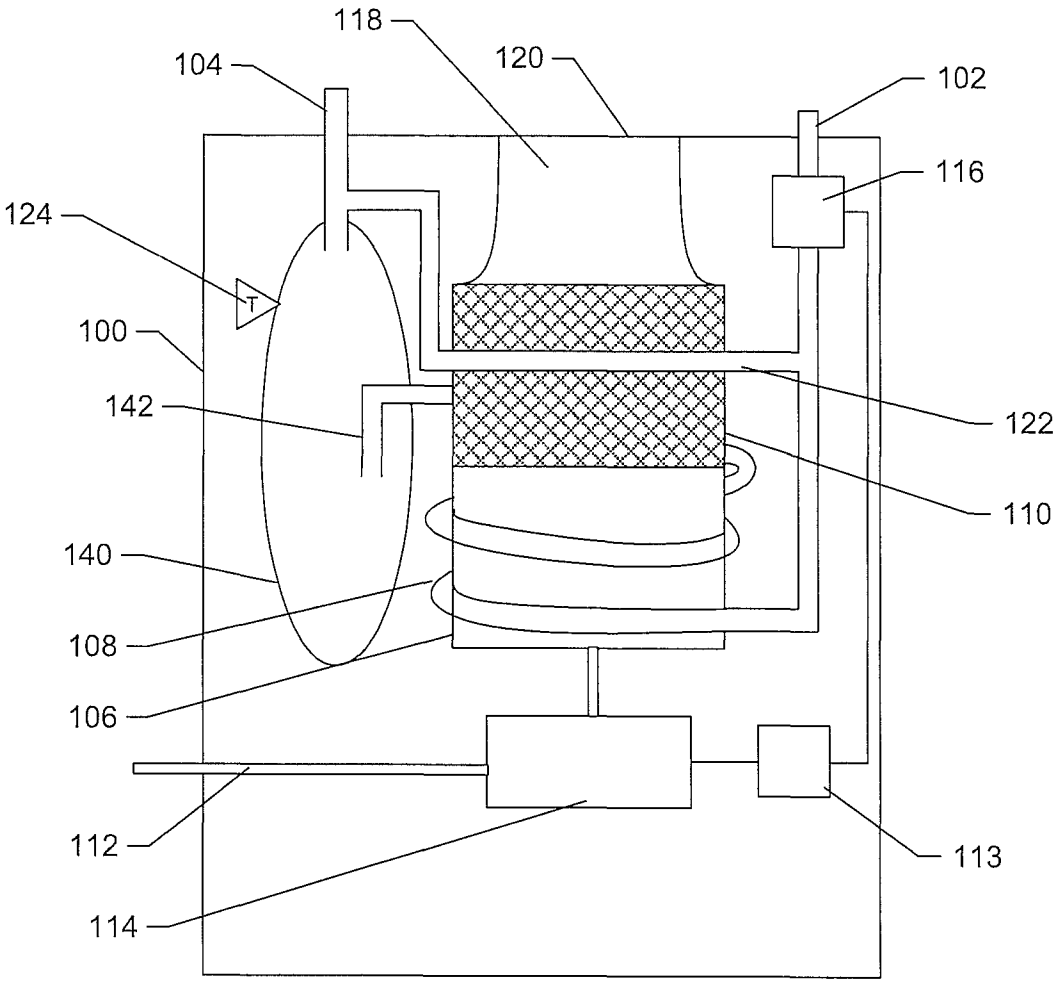
Figure 4:
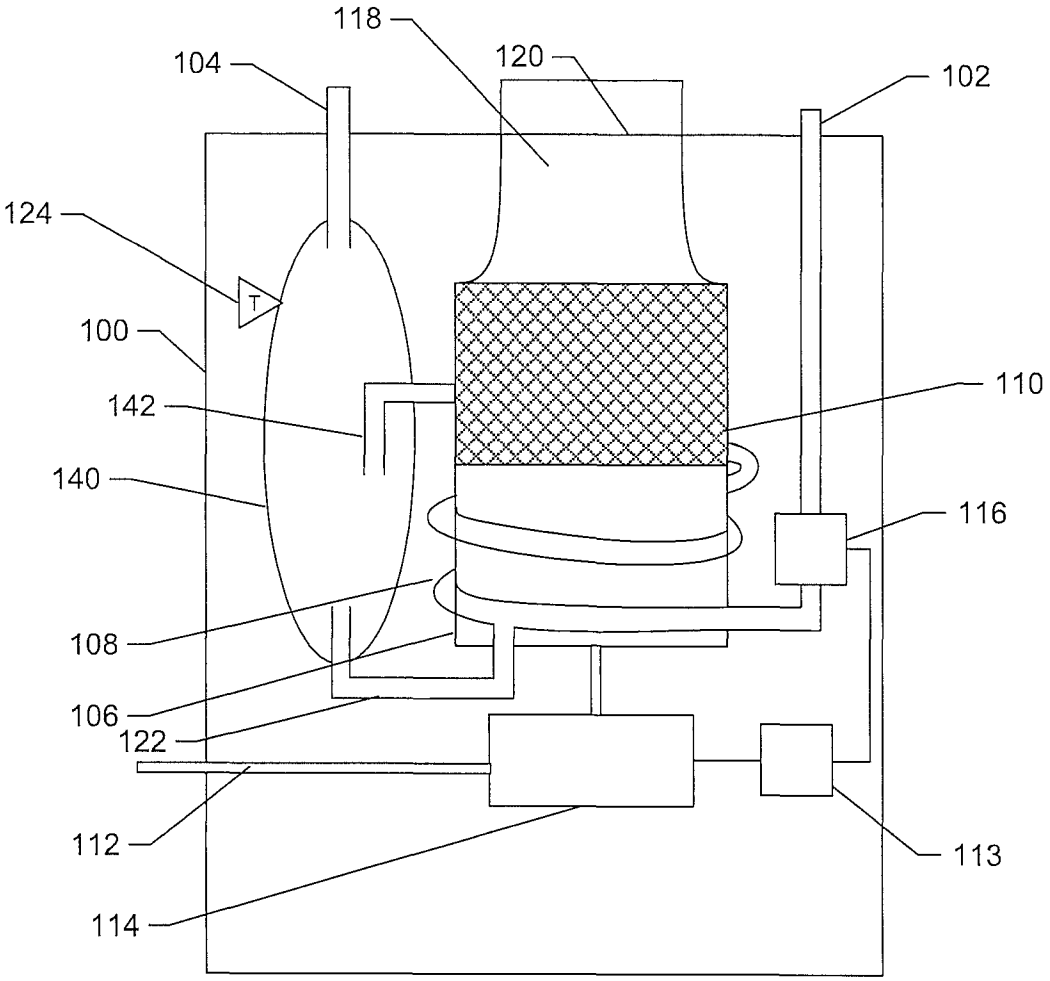
Figure 5:
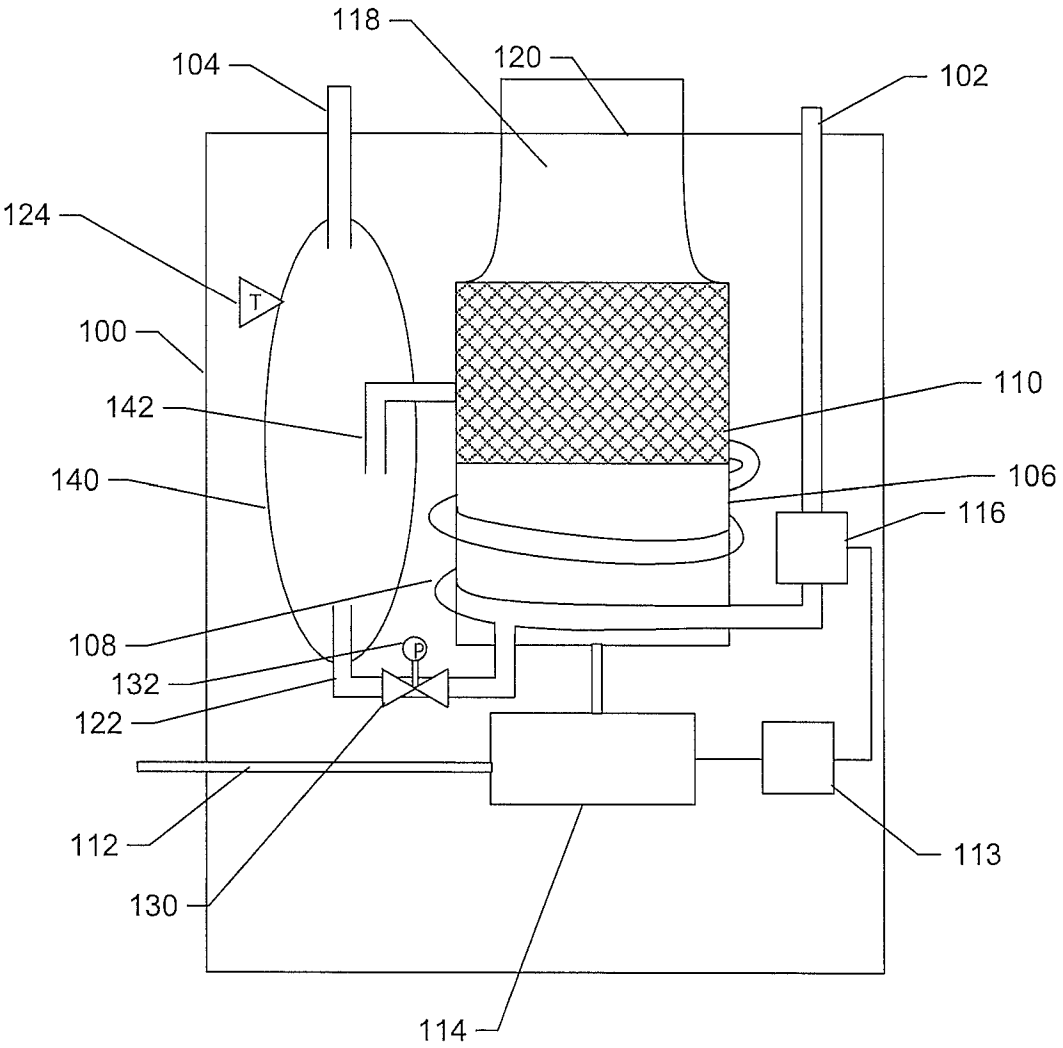
Figure 6:
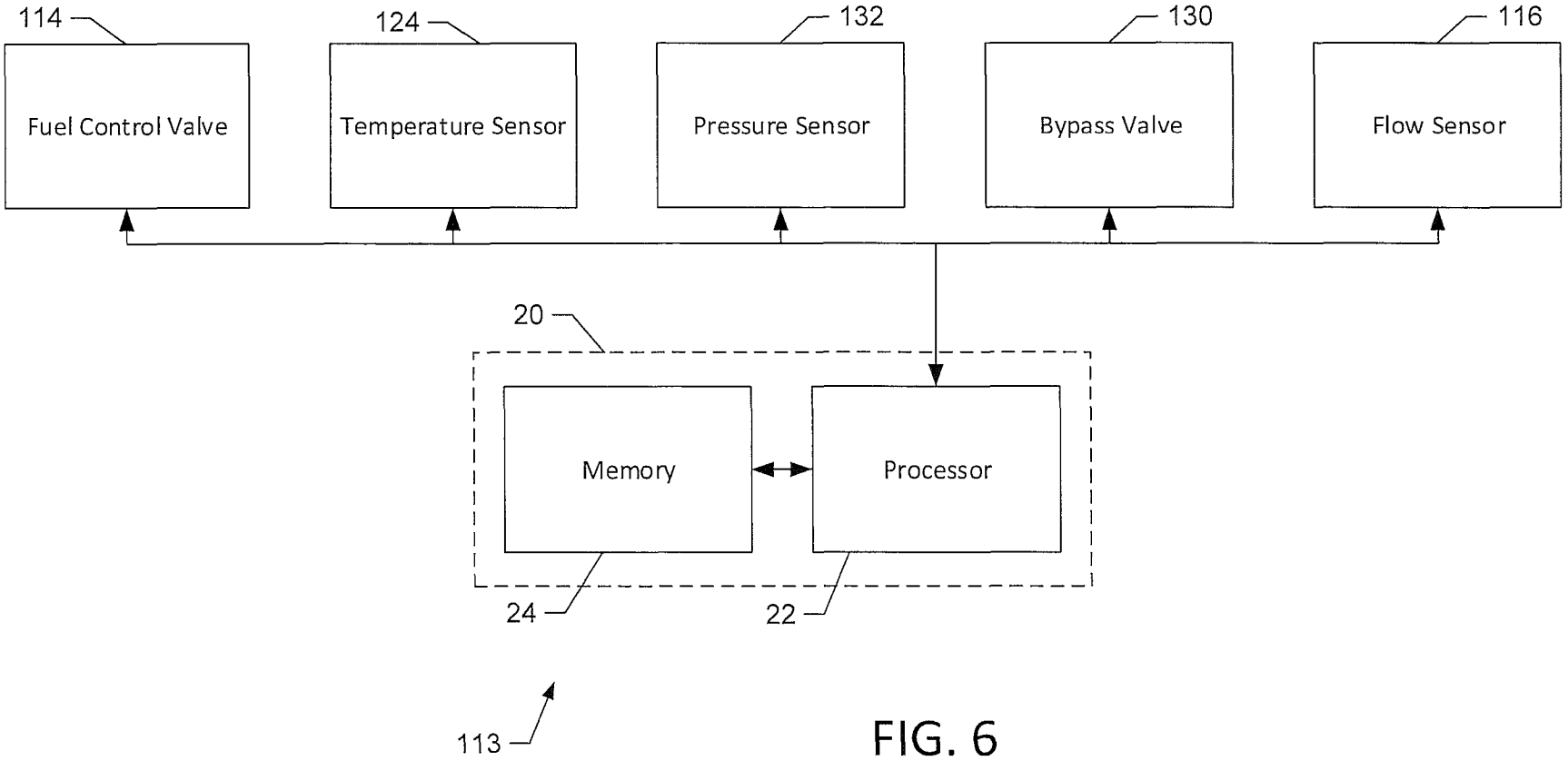
Figure 7:
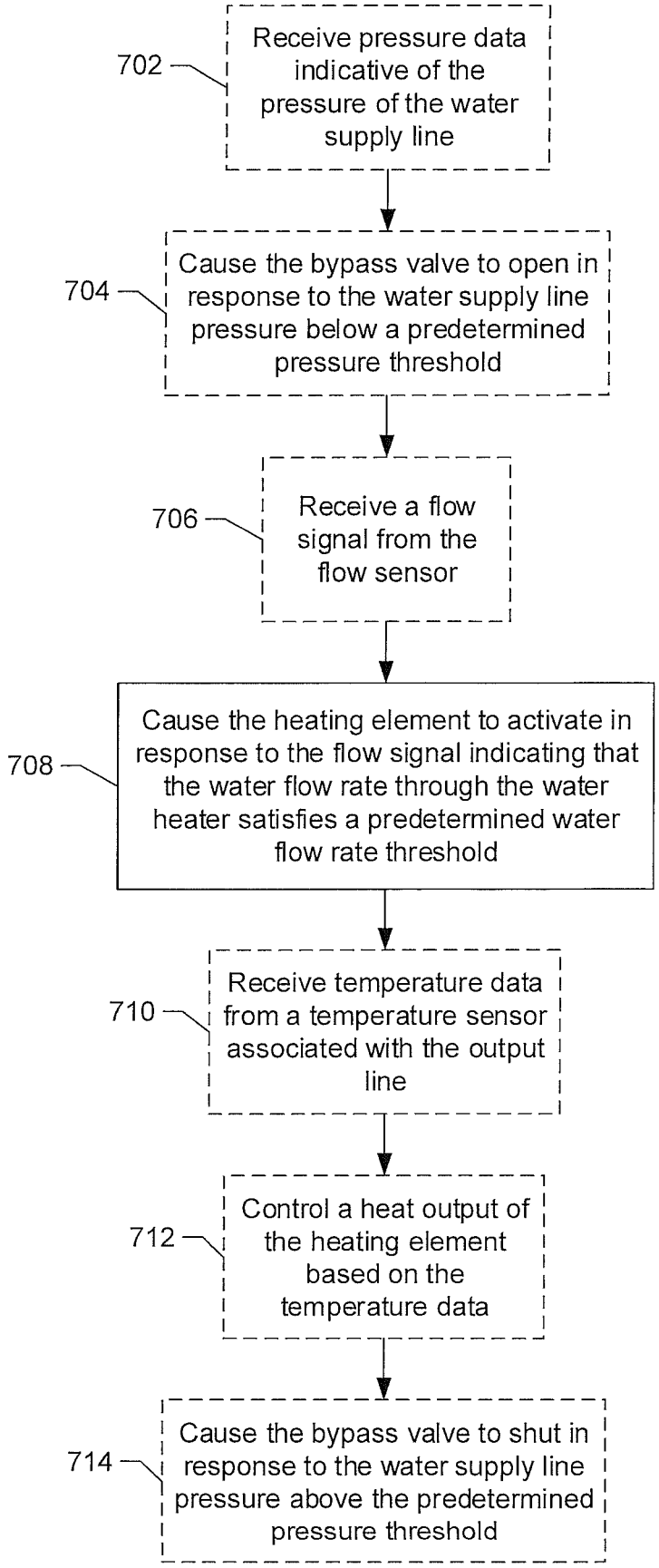

Each of FIGS. 3 and 4 is a schematic view of a tankless water heater including a storage vessel and a bypass flow line according to an example embodiment;

FIG. 5 is a schematic view of a tankless water heater including a storage vessel with a bypass valve in a bypass flow line according to an example embodiment;

FIG. 6 is a block diagram of one example of a controller according to an embodiment for use with a tankless water heater as in FIGS. 1-5; and FIG. 7 is a flow diagram of methods of controlling tankless water heaters as in FIG. 1-5.

Repeat use of reference characters in the present specification and drawings is intended to represent same or analogous features or elements of the invention according to the disclosure.

DETAILED DESCRIPTION OF PREFERRED EMBODIMENTS

Reference will now be made in detail to embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used in another embodiment to yield a still further embodiment. Thus, it is intended that the present invention covers such modifications and variations as come within the scope of the appended claims and their equivalents.

As used herein, terms referring to a direction or a position relative to the orientation of the fuel-fired heating appliance, such as but not limited to "vertical," "horizontal," "upper," "lower," "above," or "below," refer to directions and relative positions with respect to the appliance's orientation in its normal intended operation, as indicated in the Figures herein. Thus, for instance, the terms "vertical" and "upper" refer to the vertical direction and relative upper position in the perspectives of the Figures and should be understood in that context, even with respect to an appliance that may be disposed in a different orientation. As used herein, operable coupling should be understood to relate to direct or indirect connection that, in either case, enables functional interconnection of components that are operably coupled to each other.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

Example Water Heater

Figure 1:
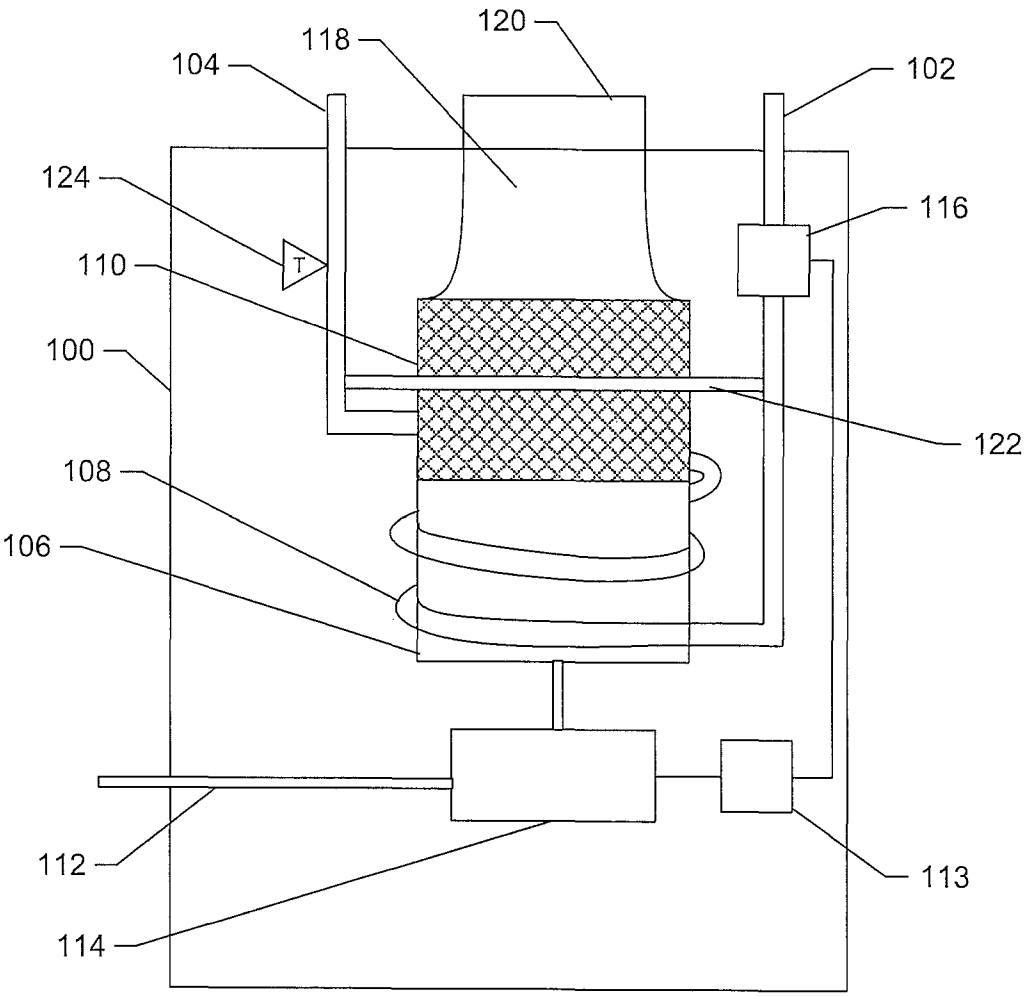
FIG. 1 is a schematic view of a tankless water heater with a bypass flow line according to an example embodiment.
Figure 2:
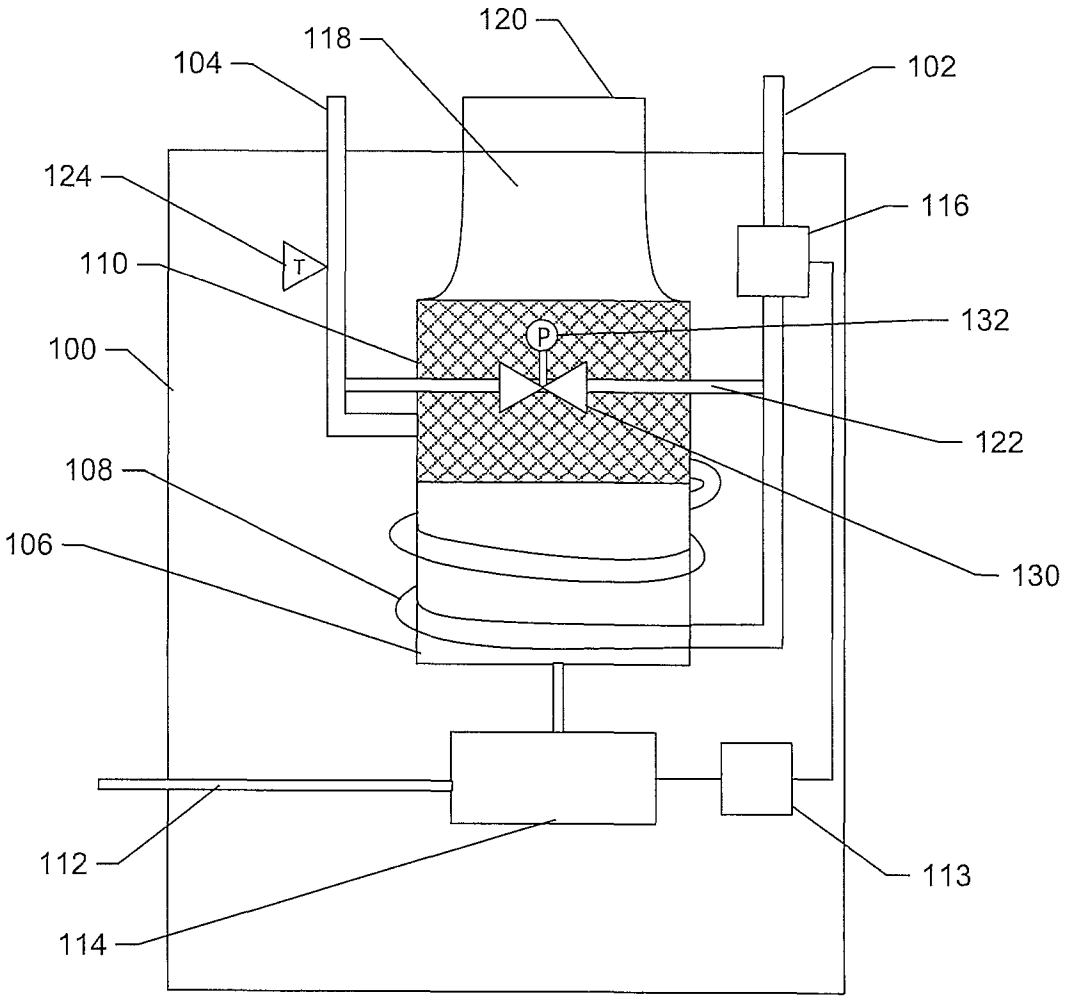
FIG. 2 is a schematic view of a tankless water heater with a bypass valve in a bypass flow line according to an example embodiment.

FIGS. 1 and 2 illustrate a water heater 100 including a cold water flow bypass path 122. The depicted water heater 100 of FIGS. 1 and 2 may or may not include a storage tank (as discussed in more detail below) but does include a heat exchanger having sufficient heat transfer capability to heat water flowing through the water heater to a predetermined temperature (set point) as the water flows through the heat exchanger, without need of a storage tank at which to deliver heat to the water. Such water heaters may be referred to as being "tankless," "instantaneous," or "on-demand." Water heater 100 may include a water supply line 102, which may be connected to a water source, such as a municipal cold water supply. Water heater 100 may include a hot water outlet 104 connected downstream to one or more plumbing fixtures, such as sinks, showers, tubs, or the like, so that water heater 100 provides hot water to the fixtures via outlet 104.

Water heater 100 includes a heating element, such as a fuel-fired burner, 106. While the heating element is described as a fuel-fired burner heating element, one of ordinary skill in the art should appreciate that electric resistance heating elements may be used in addition or alternatively. Burner 106 may be configured to burn methane or other combustible fuel and may be operably coupled to a fuel control valve 114 configured to supply or prevent the flow of fuel from a fuel source line 112 to burner 106. Fuel source line 112 may be operably coupled to a fuel source, such as a residential or commercial natural gas line. Burner 106 may produce heat by combustion and be disposed proximate, such as beneath, a heat exchanger 110. Heat and combustion exhaust generated by burner 106 may travel upward, due to thermal circulation and vent paths, through heat exchanger 110 and a flue 118 and exit water heater 100 through an exhaust port 120. Exhaust port 120 may be operably coupled to vent ducting (not shown) to vent the exhaust external to a building, such as when the water heater 100 is disposed internally to a building.

A portion 108 of the water input line may be operably coupled between cold water supply line 102 and the heat exchanger and wrap about burner 106 so that radiating heat from burner 106 transfers to warming line portion 108 and, by transferring through the water line walls, warms the water flowing therein. As a result, while warming line 108 is described herein as a part of water input line 102, it may also be considered part of heat exchanger 110. Heat exchanger 110 may include an input port that receives water from water line 108 and that opens into a manifold that distributes the cold water to a plurality of fluid flow paths, e.g. tubes, plates, plate fins, or other conduits within heat exchanger 110 that connect, at their opposite ends, to an output manifold that connects to an output port to which hot water outlet line 104 is fluidly connected. Within the heat exchanger, the hot exhaust gas generated by burner 106 flows over the plurality of conduits (i.e. the heater exchanger housing and the plurality of water conduits form therebetween a flow path for the exhaust gas), transferring heat from the exhaust gas to the water flowing through the conduits. The water conduits may be formed from aluminum or other material with a high heat transfer coefficient. In some example embodiments, the water conduits of heat exchanger 110 may be configured to provide a torturous path for exhaust flow, including cross flow and back flow, to increase the heat exchanger's area available to receive heat from the exhaust gas to the water, thereby increasing the amount of heat transfer to the water. The torturous path through heat exchanger 110 may be formed from straight fins, offset fins, wavy fins, or the like and, as discussed above, establishes a sufficient surface area for heat transfer between the flowing exhaust gas and the flowing water that the heat exchanger warms the water to a desired temperature (set point) range as the water flows through that heat exchanger, without need of a storage tank to warm reach that temperature. The construction of heat exchangers in instantaneous water heaters should be well understood.

Fuel control valve 114 supplies fuel to the burner in response to detection of a predetermined water flow rate through water heater 100, as sensed or measured by a flow sensor 116 operatively disposed in water supply line 102 between the cold water inlet and heat exchanger 110. Fuel control valve 114 may be configured to open in response to a water flow rate greater than a predetermine demand flow rate sensed by flow sensor 116. For example, fuel flow control valve 114 may be controlled by a controller 113 operatively coupled to flow sensor 116 so that controller 113 receives a signal from flow sensor 116 indicating the rate of flow through water input line 102. Where flow sensor 116 is a flow switch having a binary output that changes state as flow rate moves above or below a threshold to which the switch is set, the signal to controller 113 conveys simply whether flow through input line 102 is at or above the threshold rate, or is below the threshold rate. In other configurations, the flow sensor output varies with water flow rate through input 102 so that the sensor output signal conveys specific flow rate data. In the latter arrangement, controller 113 receives the signal and compares the flow rate indicated thereby to a predetermined flow rate threshold. If the controller determines that the flow rate indicated by flow sensor 116 is greater than the predetermined demand flow rate, controller 113 sends a control signal to fuel control valve 114, e.g. via a suitable relay, causing valve 114 to open. That is, control valve 114 opens in response to receipt of a flow sensor signal indicating that the water flow rate satisfies, e.g. exceeds, the predetermined demand flow rate. Opening of the fuel control valve 114 supplies fuel from fuel input line 112 to burner 106 for combustion in conjunction with simultaneous activation of an igniter (not shown) at a burner surface, thus activating burner 106. The igniter is also controlled by a signal from controller 113 via circuitry that connects the igniter with an electrical power source, as should be understood. Moreover, the control and ignition of fuel to burners of instantaneous water heaters should be understood.

In other embodiments, in which flow sensor 116 is a binary flow switch, the switch outputs a signal in either of two states. When water flow through input line 102 is below a predetermined threshold level defined by the construction or setting of switch, switch is in a first state, as reflected by its output signal to controller 113. When the output signal is in this first state, controller 113 maintains burner 106 in an inactive condition. When water flow through input line 102 exceeds the threshold level, switch changes state, thereby changing the state of the output signal to the controller 113, which in turn causes the controller 113 to actuate burner 106 as described above.

In some example embodiments, the water heater may also include a temperature sensor 124, e.g. a thermistor-based device attached to the exterior of outletline 104. Temperature sensor 124 senses or measures the temperature of the heated water exiting heat exchanger 110 or water heater 100 and outputs a corresponding signal to controller 113. In response, controller 113 controls fuel control valve 114 based on the temperature of the heated water. More specifically, controller 113 receives temperature data indicative of the temperature of the heated water from temperature sensor 124, compares the indicated temperature to one or more predetermined temperature thresholds or ranges, and controls an amount of fuel supplied to the burner by fuel control valve 114 based on whatever the indicated temperature satisfies the one or more temperature thresholds or ranges. For example, if the water temperature at the outlet water line is less than 120 degrees Fahrenheit, controller 113 modifies the control signal to the fuel control valve to supply fuel at a 100 percent flow rate. However, if the temperature data indicates a water temperature greater than 120 degrees Fahrenheit, or e.g. greater than 130 degrees Fahrenheit, the controller modifies the control signal to cause the fuel control valve to limit the fuel flow rate to 50 percent or 25 percent, respectively. Multiple temperature thresholds may allow for greater heated water temperature regulation by water heater 100.

In some embodiments, water heater 100 includes a bypass flow line 122 that is operably coupled, i.e. fluidly connected, between cold water supply line 102 and hot water outlet line 104. Bypass flow line 122 allows flow of cold water between water supply line 102 and hot water outlet 104, bypassing heat exchanger 110. Flow sensor 116 is disposed upstream of the bypass, such that flow sensor 116 senses or measures water flow through the water heater as a whole, including both the flow through bypass flow line 122 and through heat exchanger 110. Bypass flow line 122 provides a flow path through water heater 100 that has a resistance to water flow that is less than the resistance to flow presented by heat exchanger 110, including warming line 108, thereby lowering the resistance to flow seen by cold water input line 102 downstream from flow sensor 116. Because water flow rate through sensor 116 depends upon the counterbalancing factors of water pressure in line 102 and resistance to flow downstream from line 102, when a drop in water pressure in line 102 occurs, the lower resistance presented by the combination of heat exchanger 110 and bypass flow line 122 (as compared to the flow resistance that would be seen downstream from input line 102 by heat exchanger 110 alone, in the absence of bypass path 122) results in a water flow rate through flow sensor 116 that is higher than the flow rate that would exist in the absence of bypass line 122. Accordingly, bypass 122 maintains a water flow rate through sensor 116 above the threshold water flow rate needed to change the state of flow sensor 116 (or, if the sensor outputs a signal corresponding directly to flow rate, above the flow rate needed for controller 113 to determine the existence of demand), and thereby cause flow sensor 116 to send the output signal to controller 113 that causes controller 113 to actuate burner 106, over a range of water pressure at cold water input line 102 lower than would occur in absence of bypass 122. That is, bypass 122 enables the flow rate though water heater 100 to consistently satisfy the predetermined demand threshold when connected to a water source that experiences lower pressure conditions than would be possible in absence of bypass 122.

In some example embodiments, such as the example depicted in FIG. 2, water heater 100 includes a bypass valve 130 configured to control the flow of fluid through bypass flow line 122. Bypass valve 130 is controllable by controller 113 (e.g. via a suitable relay) to open to allow flow through bypass flow line 122 and to shut to restrict or prevent flow through bypass flow line 122. Water heater 100 may also include a pressure sensor 132 configured to sense a pressure of water flowing through the water heater. Although illustrated in FIG. 2 as being operably coupled to the bypass line (upstream from valve 130), in other embodiments pressure sensor 132 is operably coupled to the water supply line 102 or flow sensor 116, in any event so that pressure sensor 132 measures the pressure of the water supply line 102 and thereby the pressure of the water source. Controller 113 receives the output signal from the pressure sensor and compares the corresponding pressure to a threshold pressure. If the pressure is above the threshold, the controller maintains valve 130, and therefore bypass 122, closed. If the pressure falls below the threshold, the controller opens the valve, and therefore the bypass, thereby allowing the water heater to operate within a range of low pressure conditions in which it would otherwise cease operation. Valve 130 may be, for example, a solenoid-controlled valve. Such a valve can be a normally-open valve, such that controller 113 changes the valve's state upon detecting that pressure in input line 102 is above the threshold pressure, or a normally-closed valve, such that controller 113 changes the valve's state upon detecting that pressure in input line 102 is below the threshold pressure.

FIGS. 3-5 illustrate example water heaters including a storage vessel 140. Water heaters 100 depicted in FIGS. 3-5 may be substantially similar to the water heaters discussed above with respect to FIGS. 1 and 2, except for tank 140 and, as otherwise discussed herein, should be understood to operate similarly. In an example embodiment, hot water outlet 104 includes storage vessel 140 and a heat exchanger outlet line 142 that conveys heated water from heat exchanger 110 to storage vessel 140. Storage vessel 140 may be configured to store a volume of heated water, such as five liters, seven liters, ten liters, or the like. In some example embodiments, storage vessel 140 may be insulated, such as by foam, fiber glass, or the like, to thereby limit thermal losses from the heated water while being stored in storage vessel 140.

Storage vessel 140 may receive heated water from heat exchanger outlet line 142 near the bottom of storage vessel 140. Heat exchanger outlet 142 may further be configured to cause turbulent flow as the heated water enters storage vessel 140 to cause increased mixing of the heated water already stored in storage vessel 140 with the heated water flowing into the storage vessel. In an example embodiment, temperature sensor 124 may be operably coupled to an exterior surface of storage vessel 140.

The storage vessel may limit or prevent temperature fluctuations of the heated water. In an example embodiment, storage vessel 140 may provide heated water to one or more plumbing fixtures as water flowing through the heat exchanger is heated.

Water heater 100 may include a bypass flow line 122 disposed between water supply line 102 and the hot water outlet 104. In the embodiment depicted in FIG. 3, for example, bypass flow line 122 is operably coupled to the output flow line downstream of storage vessel 140. In the example embodiment depicted in FIG. 4, bypass flow line 122 is operably coupled directly to storage vessel 140, such that bypass flow line 122 discharges unheated into storage vessel 140. Bypass flow line 122 may be operably coupled to water supply line 102 upstream of the burner housing or to warmup line 108, which wraps around the burner housing as discussed above. In a third embodiment (not shown), bypass line 122 fluidly couples at its output with line 142 upstream of tank 140. In any of these embodiments, however, water from bypass flow line 122 mixes with the water exiting heat exchanger outlet 142 and the water in the storage vessel 140.

In any of the embodiments in which water heater 100 includes storage vessel 140, the water heater may also include a bypass valve 130 and pressure sensor 132, which are configured and operate as discussed above with respect to FIG. 2. Control valve 130 may be disposed in bypass flow line 122, where the bypass line operably couples to the output flow line upstream or downstream of the storage vessel. Additionally or alternatively, bypass valve 130 may be disposed in a bypass flow line 122 that operably couples directly to the storage vessel 140, as depicted in FIG. 5.

Example Controller

FIG. 6 illustrates certain elements of controller 113 for use with a water heater 100. Controller 113 may be employed, for example, as on-board circuitry associated with the water heater. Accordingly, some embodiments of controller 113 may be embodied wholly at a single device or by devices in a client/server relationship. Furthermore, it should be noted that the devices or elements described below may not be mandatory and, thus, some may be omitted in certain embodiments.

In an example embodiment, the controller may include or otherwise be in communication with processing circuitry 20 that is configured to perform data processing, application execution and other processing and management services according to an example embodiment of the present invention. In one embodiment, processing circuitry 20 includes a memory 24 and a processor 22. As such, processing circuitry 20 may be embodied as a circuit chip (e.g. an integrated circuit chip) configured (e.g. with hardware, software or a combination of hardware and software) to perform operations described herein.

In an example embodiment, memory 24 may include one or more non-transitory storage or memory devices such as, for example, volatile and/or non-volatile memory that may be either fixed or removable. Memory 24 may be configured to store information, data, applications, instructions or the like for enabling the apparatus to carry out various functions in accordance with example embodiments of the present invention among other operational features (including controlling the burner, operating error notification devices, etc.). For example, memory 24 could be configured to buffer input data for processing by processor 22. Additionally or alternatively, memory 24 could be configured to store instructions for execution by processor 22. As yet another alternative, memory 24 may include one of a plurality of databases that may store a variety of files, contents, or data sets. Among the contents of memory 24, applications may be stored for execution by processor 22 in order to carry out the functionality associated with each respective application.

Processor 22 may be embodied in a number of different ways, for example as various processing means such as a microprocessor or other processing element, a coprocessor, a controller or various other computing or processing devices including integrated circuits such as, for example, an ASIC (application specific integrated circuit), an FPGA (field programmable gate array), a hardware accelerator, or the like. In an example embodiment, processor 22 may be configured to execute instructions stored in memory 24 or otherwise accessible to processor 22. As such, whether configured by hardware or software methods, or by a combination thereof, processor 22 may represent an entity (e.g. physically embodied in circuitry) capable of performing operations according to embodiments of the present invention while configured accordingly. Thus, for example, when processor 22 is embodied as an ASIC, FPGA or the like, processor 22 may be specifically configured hardware for conducting the operations described herein. Alternatively, as another example, when processor 22 is embodied as an executor of software instructions, the instructions may specifically configure processor 22 to perform the operations described herein.

In an example embodiment, processing circuitry 20 may include or otherwise be in communication with a temperature sensors 124. Temperature sensors 124 may be disposed at hot water outlet 104, storage vessel 140, or the like. Temperature sensor 124 may be configured to provide temperature data to processor 22 indicative of a temperature of the heated water. Temperature sensor 124 may include one or more of a thermistor, a thermocouple, a resistance thermometer, or the like.

In some example embodiments, processing circuitry 20 may include or otherwise be in communication with flow sensor 116. Flow sensor 116 may be disposed in water supply line 102 and provide processing circuitry 20 with flow rate data indicative of the flow rate of the water through the water heater 100. Flow sensor 116 may include one or more of an orifice flow sensor, a venturi flow sensor, a nozzle flow sensor, a rotameter, pitot tubes, calorimetrics, a turbine flow sensor, a vortex flow sensor, an electromagnetic flow sensor, a Doppler flow sensor, an ultrasonic flow sensor, a thermal flow sensor, a Coriolis flow sensor, or the like.

In some example embodiments, processing circuitry 20 may include or otherwise be in communication with bypass valve 130. The bypass valve may be solenoid actuated, servo actuated, hydraulically actuated, or the like. Bypass valve 130 may be a gate valve, butterfly valve, proportional valve, needle valve, or the like configured to selectively restrict or prevent flow through the bypass flow line 122.

In some example embodiments, processing circuitry 20 may include or otherwise be in communication with a pressure sensor 132. Pressure sensor 132 may be disposed in water supply line 102, the bypass line 122, or in association with bypass valve 130. Pressure sensor 132 may be configured to sense or measure the pressure of the water supply line 102 and thereby a water source. Pressure sensor 132 may include a force collector sensor, such as a piezoresistive strain gauge, a capacitive sensor, an electromagnetic sensor, a piezoelectric sensor, an optical sensor, a potentiometric sensor or the like. Additionally or alternatively, pressure sensor 132 may include a resonant sensor, thermal sensor, or ionization sensor, or the like.

Example Flowchart(s) and Operations

FIG. 7 provides a flowchart illustrating an example method for controlling a water heater according to an example embodiment. The operations illustrated in and described with respect to FIG. 7 may, for example, be performed by, with the assistance of, and/or under the control of one or more of processor 22, memory 24, fuel control valve 114, temperature sensor 124, pressure sensor 132, bypass valve 130, and flow sensor 116, as described above with respect to FIGS. 1-5. The method may include causing the heating element (e.g. burner 106) to activate in response to the flow signal indicating that the water flow rate through the water heater satisfies a predetermined water flow rate threshold at operation 708.

In some embodiments, the method may include additional, optional operations, and/or the operations described above may be modified or augmented. Some examples of modifications, optional operations, and augmentations are described below, as indicated by dashed lines, such as, receiving pressure data indicative of the pressure of the water supply line at operation 702, causing the bypass valve to open in response to the water supply line pressure below a predetermined pressure threshold at operation 704, and receiving a flow signal from the flow sensor at operation 706. In some example embodiments, the method may also include receiving temperature data from a temperature sensor associated with the output line at operation 710, controlling a heat output of the heating element based on the temperature data at operation 712, and causing the bypass valve to shut in response to the water supply line pressure above a predetermined pressure threshold at operation 714.

FIG. 7 illustrates a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable media having computer readable program instructions stored thereon. For example, one or more of the procedures described herein may be embodied by computer program instructions of a computer program product. In this regard, the computer program product(s) that embody the procedures described herein may be stored by, for example, memory 24 and executed by, for example, processor 22. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

In some embodiments, the system may be further configured for additional operations or optional modifications. In this regard, in an example embodiment, the bypass flow line is fluidly connected between the water supply line and the storage vessel. In some example embodiments, the water heater also includes processing circuitry configured to receive a flow signal from the flow sensor and cause the heating element to activate in response to the flow signal indicating that the water flow through the water heater satisfies the predetermined water flow rate. In an example embodiment, the processing circuitry is further configured to receive temperature data from a temperature sensor associated with the output line and control a heat output of the heating element based on the temperature data. In some example embodiments, the water heater also includes a bypass valve configured to control flow in the bypass flow line. In an example embodiment, the water heater also includes a pressure sensor associated with the water supply line and the processing circuitry is further configured to receive pressure data indicative of the pressure of the water supply line and cause the bypass valve to open in response to the water supply line pressure being below a predetermined pressure threshold. In some example embodiments, the flow switch is disposed in the water supply line. In an example embodiment, the bypass flow line is operably coupled to the water supply line downstream of the flow switch. In some example embodiments, the bypass flow line reduces the restriction to flow between the water supply line and the output line. In an example embodiment, the bypass flow line is operably coupled to the outlet downstream of the storage vessel. In some example embodiments, the storage vessel is thermally insulated.

Many modifications and other embodiments ofthe inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A water heater comprising:

(a) a heat exchanger in fluid communication with a water supply line;

(b) a heating element positioned proximate to the heat exchanger, so that, when activated, the heating element conveys heat to the heat exchanger, thereby heating water supplied to the heat exchanger by the water supply line;

(c) an output line in fluid communication with the heat exchanger and configured to receive heated water therefrom;

(d) a water flow sensor in operative communication with water flow to or in the water heater to detect water flow from the water supply line to the water heater and in operative communication with the heating element to cause the heating element to activate in response to detection of a predetermined water flow rate by the water flow sensor;

(e) a bypass water flow line operably connected between the water supply line and the output line;

(f) a pressure sensor in operative communication with the water supply line to detect a pressure of water in the water supply line;

(g) a valve in operative communication with the bypass water flow line so that operation of the valve controls water flow in the bypass water flow line; and (h) process circuitry configured to receive pressure data indicative of the pressure of water in the water supply line and cause the valve to open in response to the pressure of water in the water supply line being below a predetermined pressure threshold.

2. The water heater of claim 1 wherein the process circuitry is further configured to:

(a) receive a flow signal from the flow sensor, and (b) cause the heating element to activate in response to the flow signal indicating that the water flow through the water heater satisfies the predetermined water flow rate.

3. The water heater of claim 1, wherein the processing circuitry is further configured to:

(a) receive temperature data from a temperature sensor in operative communication with the output line, to detect a temperature of water flow therethrough, and (b) control a heat output of the heating element based on the temperature data.

4. The water heater of claim 1, wherein the water flow sensor is disposed in the water supply line.

5. The water heater of claim 4, wherein the bypass water flow line is operably coupled to the water supply line downstream of the flow sensor.

6. The water heater of claim 1, wherein the bypass water flow line is disposed with respect to the water supply line and the heat exchanger so that when water flows into the water heater from the water supply line, the bypass water flow line reduces resistance to flow between the water supply line and the output line.

7. A water heater comprising:

(a) a heat exchanger in fluid communication with a water supply line;

(b) a heating element positioned proximate to the heat exchanger so that, when activated, the heating element conveys heat to the heat exchanger, thereby heating water supplied to the heat exchanger by the water supply line;

(c) an output line in fluid communication with the heat exchanger and configured to receive heated water therefrom, wherein the output line comprises a storage vessel configured to store a volume of the heated water;

(d) a water flow sensor in operative communication with water flow to or in the water heater to detect water flow from the water supply line to the water heater and in operative communication with the heating element to cause the heating element to activate in response to sensing a predetermined water flow rate by the water flow sensor; and (e) a bypass water flow line operably connected between the water supply line and the output line.

8. The water heater of claim 7, wherein the bypass flow line is fluidly connected between the water supply line and the storage vessel.

9. The water heater of claim 7 further comprising: processing circuitry configured to:

(a) receive a flow signal from the flow sensor, and (b) cause the heating element to activate in response to the flow signal indicating that the water flow through the water heater satisfies the predetermined water flow rate.

10. The water heater of claim 9, wherein the processing circuitry is further configured to:

(a) receive temperature data from a temperature sensor in operative communication with the output line to detect temperature of water flow therethrough, and control a heat output of the heating element based on the temperature data.

11. The water heater of claim 9 further comprising:

(a) a valve in operative communication with the bypass flow line so that operation of the valve controls flow of water in the bypass flow line.

12. The water heater of claim 11 further comprising:

(a) a pressure sensor in operative communication with the water supply line to detect pressure of water in the water supply line, and (b) wherein the processing circuitry is further configured to receive pressure data indicative of the pressure of water in the water supply line and cause the valve to open in response to the water supply line pressure being below a predetermined pressure threshold.

13. The water heater of claim 7, wherein the flow sensor is disposed in the water supply line.

14. The water heater of claim 13, wherein the bypass flow line is operably coupled to the water supply line downstream of the flow sensor.

15. The water heater of claim 7, wherein the bypass flow line is disposed with respect to the water supply line and the heat exchanger so that when water flows into the water heater from the water supply line, the bypass flow line reduces resistance to flow between the water supply line and the output line.

16. The water heater of claim 7, wherein the bypass flow line is operably coupled to the output line downstream of the storage vessel.

17. The water heater of claim 7, wherein the storage vessel is thermally insulated.

* * * * *